US007023683B1

(12) United States Patent
Guo et al.

(10) Patent No.: US 7,023,683 B1
(45) Date of Patent: Apr. 4, 2006

(54) ELECTRIC RELAY CONTROL CIRCUIT

(75) Inventors: Sam Guo, Canton, MI (US); James Jones, III, White Lake, MI (US); Chidambarakrishnan Rajesh, Canton, MI (US)

(73) Assignee: Yazaki North America, Inc, Canton, MI (US)

( * ) Notice: Subject to any disclaimer, the term of this patent is extended or adjusted under 35 U.S.C. 154(b) by 562 days.

(21) Appl. No.: 10/234,744

(22) Filed: Sep. 4, 2002

(51) Int. Cl.
*H01H 47/00* (2006.01)

(52) U.S. Cl. ..... 361/166; 307/132 E; 361/191; 361/3

(58) Field of Classification Search ..... 307/134, 307/115, 132 E, 77, 10.7, 140, 61, 50, 54; 361/191, 166, 3; 320/116, 120, 121
See application file for complete search history.

(56) References Cited

U.S. PATENT DOCUMENTS 3,628,056 A * 12/1971 Buchanan ..... 307/10.3
3,739,192 A * 6/1973 Oswald ..... 361/3
4,152,634 A * 5/1979 Penrod ..... 361/3
4,412,137 A 10/1983 Hansen et al.
4,598,330 A * 7/1986 Woodworth ..... 361/3
4,674,031 A * 6/1987 Siska, Jr. ..... 307/40
5,173,653 A 12/1992 Hochstein
5,317,475 A * 5/1994 Siepmann ..... 361/191
5,448,152 A 9/1995 Albright
5,498,950 A 3/1996 Ouwerkerk
5,517,378 A * 5/1996 Asplund et al. ..... 361/3
5,708,337 A * 1/1998 Breit et al. ..... 318/439
5,811,959 A 9/1998 Kejha
5,945,808 A 8/1999 Kikuchi et al.
6,225,788 B1 * 5/2001 Kouzu et al. ..... 320/150
6,239,579 B1 5/2001 Dunn et al.
6,268,710 B1 7/2001 Koga
6,271,605 B1 8/2001 Carkner et al.
6,718,927 B1 * 4/2004 Goetze et al. ..... 307/10.6

* cited by examiner

*Primary Examiner*—Brian Sircus
*Assistant Examiner*—Andrew Deschere
(74) *Attorney, Agent, or Firm*—Rader, Fishman & Grauer PLLC

(57) ABSTRACT

A circuit and method for controlling two or more electric relays, wherein at least one of the relays are rated to handle a higher voltage level while at least one of the relays are rated to handle a lower voltage level. A controller selectively activates the relays such that the higher voltage rated relay(s) open before but close after the lower voltage rated relay(s) within the system.

20 Claims, 6 Drawing Sheets

ELECTRIC RELAY CONTROL CIRCUIT

FIELD OF THE INVENTION

The present invention relates generally to the control of electrical relays, and, more specifically, to a new circuit and method for closing and opening multiple electrical relays in a safe manner.

BACKGROUND OF THE INVENTION

High voltages required for an application are often obtained by connecting multiple smaller voltage sources in series. For instance, an electric or hybrid automobile design may call for twenty 42 volt batteries to be connected in series in order to satisfy the 800 volt minimum power source required by the vehicle. This use of multiple smaller voltage sources over one larger source is preferable as there is less concern of safety in the handling of smaller voltages.

To assure further safety, relay switches are often utilized in applications like that described above. When high voltage is needed, relay switches in-between each smaller voltage source can be closed, thereby closing the circuit and placing each smaller voltage source in series with one another. When high voltage is no longer needed, i.e. an electric car turned off, the relay switches are opened. In this manner, high voltage is present only when necessary while individual small voltages are present at all other times, thereby increasing the overall safety of the system.

In typical systems where relay switches connect multiple voltage sources in series, each relay must be rated to handle the maximum voltage of the system. For instance, in the electric automobile example presented above, each relay would need to be capable of handling 840 volts. This is because perfect timing in relay activation and deactivation is unobtainable. Even though all the coils of the relays are energized and de-energized by the same control unit, the contacts of each relay will not close and open at the same time due to inherent variation and tolerances within each relay switch. As a result, even in a controlled situation, one relay contact will close later or open earlier than the rest. The relay contact that closes last or opens first sees the highest voltage created by the summation of all the smaller voltage sources.

This situation similarly exists in uncontrolled conditions where the relay switches are unavoidably de-energized, for instance, when there is a loose battery terminal, or an inertial switch designed to cut power in an electric vehicle in the event of a crash. In these events, one relay contact will open earlier than the others, and thus see the full voltage of the system.

Based on the above, every relay in a typical multiple voltage source system needs to be rated to handle the maximum voltage created through the summation of all the individual voltage sources. Continuing on with the electric vehicle example above, although only 42 volt battery packs are utilized, each relay must be capable of handling 840 volts as any one of the relays could be the one to open first or close last, and thus see the full voltage created through the summation of all the battery packs. This results in significant expense. Therefore, the inventors hereof have recognized the need for a new circuit and method for controlling multiple relays, thereby allowing the use of lower voltage rated relays.

SUMMARY OF THE INVENTION

The present invention relates to a new circuit and method for controlling electric relays. In particular, the inventive circuit includes a means for controllably activating and deactivating two or more relays such that one or more higher voltage rated relays are closed after but opened before any lower voltage rated relays. In this manner, lower voltage rated relays can be mixed with higher voltage rated relays within an application without risking damage to the lower voltage rated relays by subjecting them to an excessive voltage level.

DESCRIPTION OF THE PREFERRED EMBODIMENT

Figure 1:
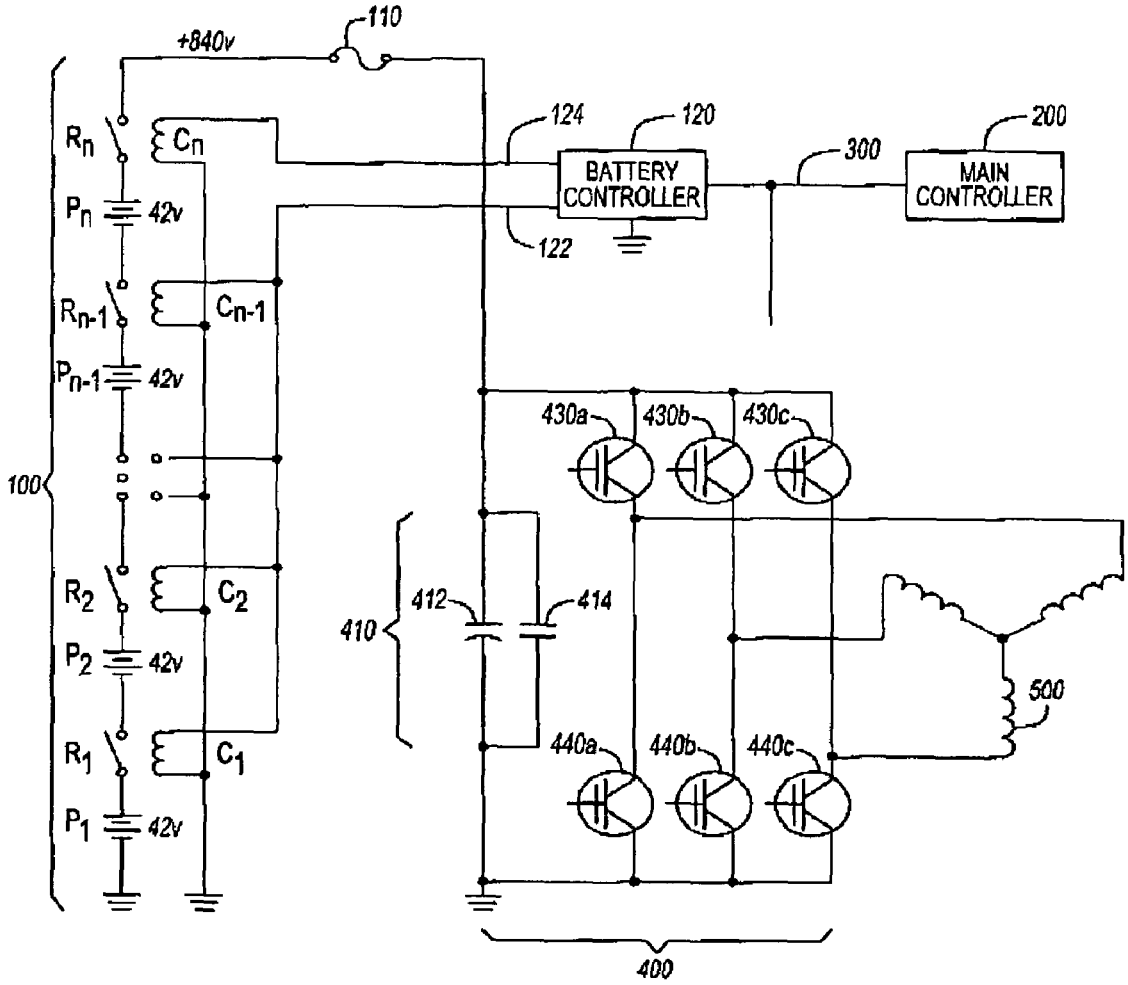
FIG. 1 is a circuit diagram that illustrates an embodiment of the present invention that includes an end-grounded battery pack and neutral-floating load.

FIG. 1 illustrates one embodiment of the electric relay control system in accordance with the present invention. In FIG. 1, multiple voltage sources, labeled P1 through Pn, are placed in series to generate a voltage greater than any of the sources individually. In FIG. 1, voltage sources P1–Pn are specifically identified as twenty 42 volt battery packs generating in total 840 volts. Although battery packs are depicted for illustrative purposes, it should be noted that the present invention can be utilized with any size and type of voltage source. Accordingly, for the remainder of the application, the term "battery pack(s)" should be understood to include any size and type of voltage source.

Connecting each battery pack P1–Pn to one another and to the load of the circuit are relay switches R1 through Rn. When relays R1–Rn are energized and placed in a closed state, battery packs P1–Pn become connected in series, thereby forming voltage source 100. In the specific example depicted in FIG. 1, voltage source 100 would equal 840 volts, and relays R1 through Rn-1 would be rated for lower voltages, such as 42 volts, while relay Rn would be rated for a higher voltage, such as the full 840 volts. Battery pack P1, representing one end of the voltage source 100, is grounded. Relay Rn, representing the other end of voltage source 100, is connected to a load and possibly an intermediate circuit necessary to properly drive the load.

For reasons of safety, the current generated by voltage source 100 may be passed through a fuse 110 or similar functioning device that can open the circuit when an abnormally high voltage or current is detected.

Each relay R1–Rn is comprised of a contact switch and an associated coil. In the embodiment depicted in FIG. 1, one end of each coil C1–Cn is connected to ground. The other end of coils C1 through Cn-1 share a connection to a first output 122 of battery controller 120 while end coil Cn, associated with higher voltage relay Rn, has its own individual connection to a second output 124 of battery controller 120.

Beyond its connections to coil Cn and coils C1 through Cn-1, battery controller 120 also communicates to a main controller 200, which oversees various subsystems of the vehicle. Based on information from the main controller 200, battery controller 120 knows when to energize and de-energize relays R1 through Rn, thereby providing power to the system.

Data is passed between the battery controller 120 and main controller 200 through a communication bus 300, which can be comprised of any type of network capable of carrying data. For example, two common types of communication buses used within the automobile industry for relaying data include the SPI or CAN bus. It is also possible for battery controller 120 and main controller 200 to communicate with other subsystems linked to the communication bus 300. For example, in an electric vehicle this may include subsystems such as the DC to AC converter 400, which in turn drives a load 500, which in this instance, would be an induction motor.

In general, the load or loads to be driven are connected in parallel to voltage source 100. Due to the nature of battery packs P1 through Pn and their associated relays R1 through Rn, the current supplied to a load can be dynamic, fluctuating up and down and generating noise or electromagnetic interference (EMI). One method of "filtering" out these fluctuations is by placing a capacitance 410 in parallel to voltage source 100. Furthermore, if multiple frequencies are present within the power signal, more than one capacitance in parallel to one another may be desired. This allows the use of a first capacitance 412, that works well at eliminating fluctuations within a lower frequency range, to be combined with a second capacitance 414 that functions more effectively at eliminating fluctuations at higher frequencies. Other capacitance combinations providing for different frequency coverage can also be readily used.

The voltage maintained across capacitance 410 can be used to drive the load of a circuit. If the present invention were utilized in an electric or hybrid vehicle, this load could be, for example, a motor and any associated circuitry needed to control it. One specific example, depicted in the figures for illustrative purposes, is a direct current to alternating current (DC/AC) converter 400, which in turn drives an induction motor 500. In this example, the DC/AC converter 400, as illustrated in FIG. 1, is a collection of transistors 430A–430C and 440A–440C grouped into series of two, with the groups then placed in parallel to one another. Each coil of an induction motor 500 is then connected to one of the series of two transistors (i.e. 430A and 440A). By then selectively activating one of the top transistors (430A–430C) and bottom transistors (440A–440C), the drive current produced by voltage source 100 is directed through two of the coils of induction motor 500, thereby generating the magnetic force necessary to rotate the drive shaft of motor 500. This DC/AC converter configuration, depicting a set of transistors in a standard bridge configuration, is typical of variable frequency drives commonly used in the hybrid or electric vehicle industry.

The operation of the electric relay control circuit depicted in FIG. 1 will now be described in detail. Voltage source 100 is activated when the load of a circuit, such as the induction motor 500, needs to be driven. Activation of voltage source 100 occurs by closing the relays R1–Rn, thereby placing battery packs P1–Pn into series. This places a large voltage, comprised of the summation of the individual battery packs, into parallel with the load to be driven. Relays R1 through Rn-1 are rated for low voltages relative to voltage source 100. For example, relays R1 through Rn-1 may be rated for only 42 volts, as compared with the overall 840 volts of the exemplary voltage source. Thus, if any of these lower voltage rated relays were the last to close within voltage source 100, this last relay would "see" the full 840 volts that the twenty 42 volt battery packs make up when connected in series, resulting in the likelihood of damage occurring to this last relay to close. To address this problem, the last relay in the series, relay Rn, is rated to handle the full voltage produced by voltage source 100, for example, 840 volts. Thus, relay Rn would not be subject to damage if it were the final relay to close and complete the circuit.

It is the responsibility of battery controller 120 to assure that voltage source 100 is activated in a manner such that relay Rn is the last relay in the series to close. Upon detecting the appropriate signal(s) or command(s) from the main controller 200 to initiate activation of voltage source 100, battery controller 120 first energizes coils C1 through Cn-1. This results in relays R1 through Rn-1 closing approximately all at the same time. As relay Rn has not yet closed, the circuit remains open and relays R1 through Rn-1 are not subject to any significantly high voltages upon their closing. Battery controller 120 then subsequently energizes coil Cn, thereby causing relay Rn to close. This completes the circuit and allows voltage source 100 to drive the load 500, which in this case is an induction motor. As relay Rn is rated to handle the full voltage of voltage source 100, which in this example is 840 volts, there is little risk of it being damaged.

Upon the closing of relay Rn, voltage source 100, which is comprised of battery packs P1–Pn, becomes connected to the circuit. Depending on the nature of the load to be driven, a power filter may be desired to stabilize the current provided by voltage source 100, which may fluctuate depending on the nature of the battery packs P1–Pn or other individual voltage sources used. As mentioned previously, one manner of filtering the voltage source 100 is by placing a capacitance 410 in parallel with it, and then driving a load off of the voltage maintained across this capacitance 410. An additional advantage of using this approach is that the capacitance can supply large, near instantaneous changes in current without causing significant current variations in the main power line. In the circuit of FIG. 1, capacitance 410 is comprised of a first capacitor 412 in parallel with a second capacitor 414. According to this arrangement, first capacitor 412 is designed to work more effectively at lower frequencies while second capacitor 414 works more effectively at higher frequencies, thereby allowing each capacitor to complement the other. Further embodiments could use various other capacitor configurations, other forms of capacitance, or even other types of power filters depending on the need of the application.

The voltage stored across capacitance 410 is then used to drive a load. For demonstrative purposes, reconsider the previous electric or hybrid vehicle example. In this situation, the voltage maintained across capacitance 410 can be distributed to the DC/AC converter 400, which in turn drives the induction motor 500.

Once the load of the circuit no longer needs to be driven, the relays R1–Rn have to be opened, thereby deactivating the voltage source 100. In order to avoid damaging the relays during this deactivation of voltage source 100, they need to be opened in a controlled manner. If one of the lower voltage rated relays R1 through Rn-1 are opened first, that specific relay could be easily damaged as it was not designed for such conditions. To prevent this from happening, the relays have to be opened in a specific sequence in order to protect them during a controlled shut-down of voltage source 100. Upon detecting the appropriate signal(s) or command(s) from main controller 200 indicating that voltage source 100 should be disabled, battery controller 120 proceeds to open the relays in the appropriate sequence. Specifically, battery controller 120 disrupts current to coil Cn first, thereby causing relay Rn to open before any of the other relays. As relay Rn is rated to handle the full voltage of voltage source 100, there is little risk of it being damaged. The battery controller 120 then disrupts the flow of current to coils C1 through Cn-1, causing the remaining relays R1 through Rn-1 to open. As the circuit has already been disrupted by the opening of relay Rn, these remaining lower voltage-rated relays can be opened without concern of being damaged.

Figure 2:
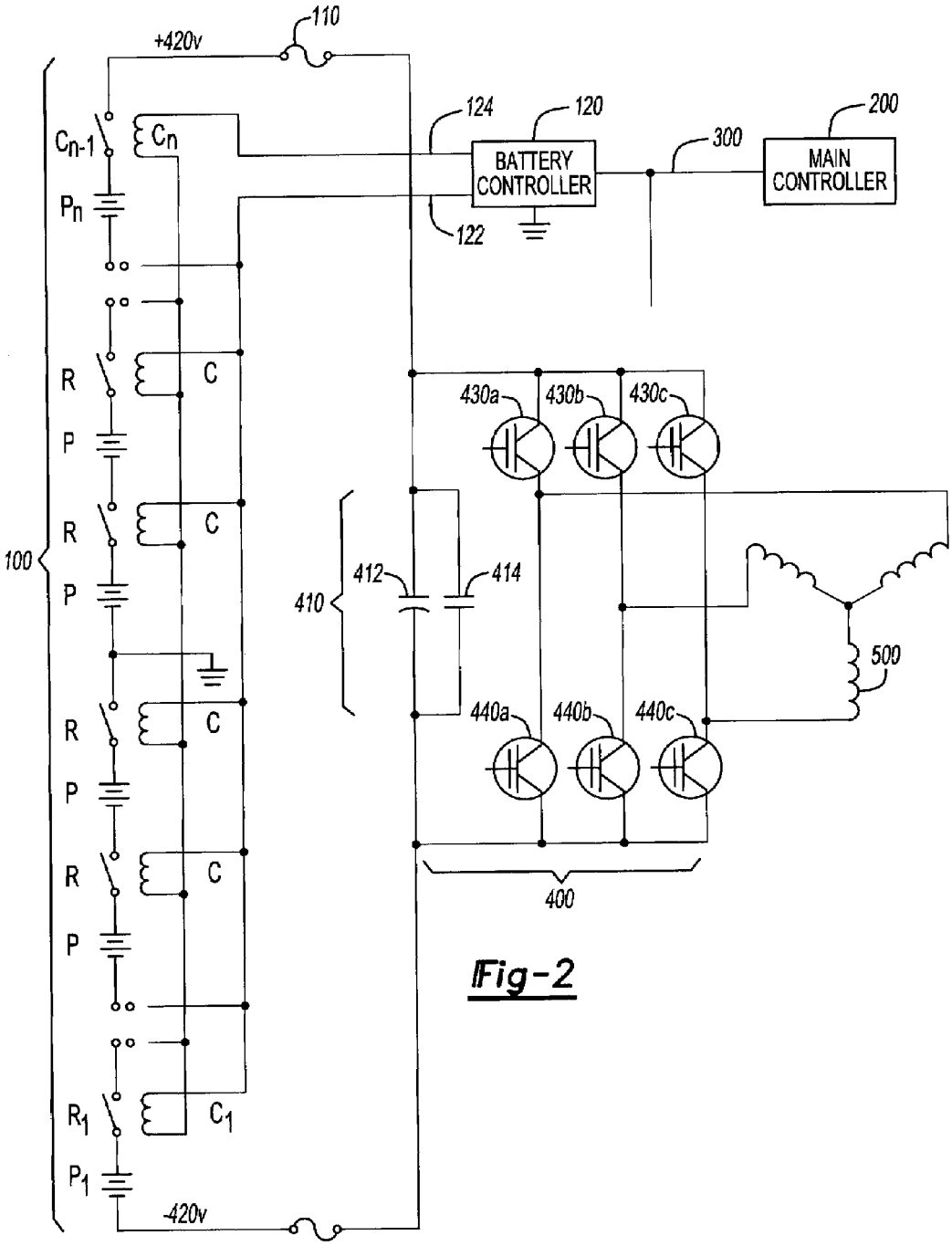
FIG. 2 is a circuit diagram that illustrates an embodiment of the present invention that includes a center-grounded battery pack and neutral-floating load.

In the current embodiment depicted in FIG. 1, one end of voltage source 100 is grounded, as is one end of capacitance 410 and DC/AC converter 400 that directly drives induction motor load 500. Depending on the load, this end-grounded battery, neutral-floating load design may be inappropriate as different load configurations may have different requirements. One alternative embodiment calls for a relay control circuit that drives a neutral-floating load, but utilizes a center-grounded battery. As depicted in FIG. 2, where like components have like reference numerals, this embodiment does not ground one end of the voltage source 100. Instead, a ground is placed at the center of voltage source 100, in-between two of its constituent battery packs. According to this arrangement, one end of voltage source 100 will possess a voltage of +420 volts, while the opposite end of voltage source 100 will possess a voltage of −420 volts. However, as it is floating, the load sees +420V−(−420V)=+840 volts. As before, the top relay Rn is rated for a higher voltage, i.e. 840 volts, while relays R1 through Rn-1 are rated for lower voltages, i.e. 42 volts.

Figure 3:
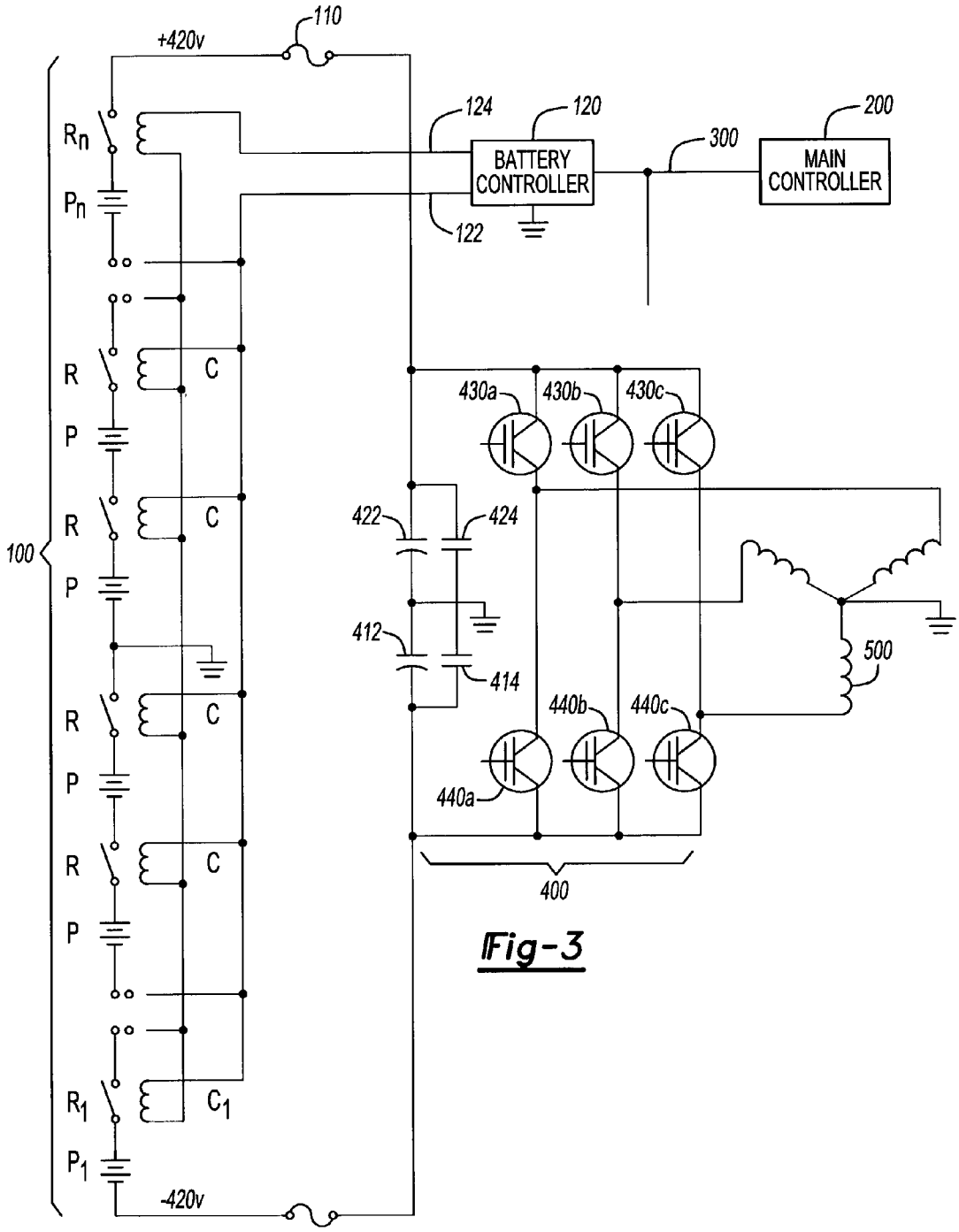
FIG. 3 is a circuit diagram that illustrates an embodiment of the present invention that includes a center-grounded battery pack and neutral-grounded load.

According to a further alternate embodiment, as shown in FIG. 3, both the center of the voltage source 100 and the center of the load are grounded. In this embodiment, the circuit is configured to have a capacitance located on both sides of the load grounding point. In the example illustrated in FIG. 3, the capacitance is comprised of 2 sets of capacitors, with one capacitor set (422 and 424) located above the ground while the other capacitor set (412 and 414) is located below the ground. In this center-grounded battery, neutral-grounded load configuration, both the top and bottom relay (R1 and Rn) contacts see half of the total voltage of voltage source 100, which according to the current example, would be 420 volts. In this configurement, both the first relay R1 and last relay Rn are rated to handle larger voltages, such as 420 volts. The remaining relays R2 through Rn-1 remain rated to handle lower voltages, i.e., 42 volts. Upon sensing the command to activate the voltage source 100, battery controller 120 energizes all the coils corresponding to all but the end two relays R1 and Rn. Upon closure of these inner relays, battery controller 120 then closes relays R1 and Rn by energizing their respective coils C1 and Cn. Similarly, upon deactivation of the circuit, the opposite occurs. Relays R1 and Rn are opened first as they are rated to handle larger voltages. The remaining relays can then be safely opened.

Figure 4:
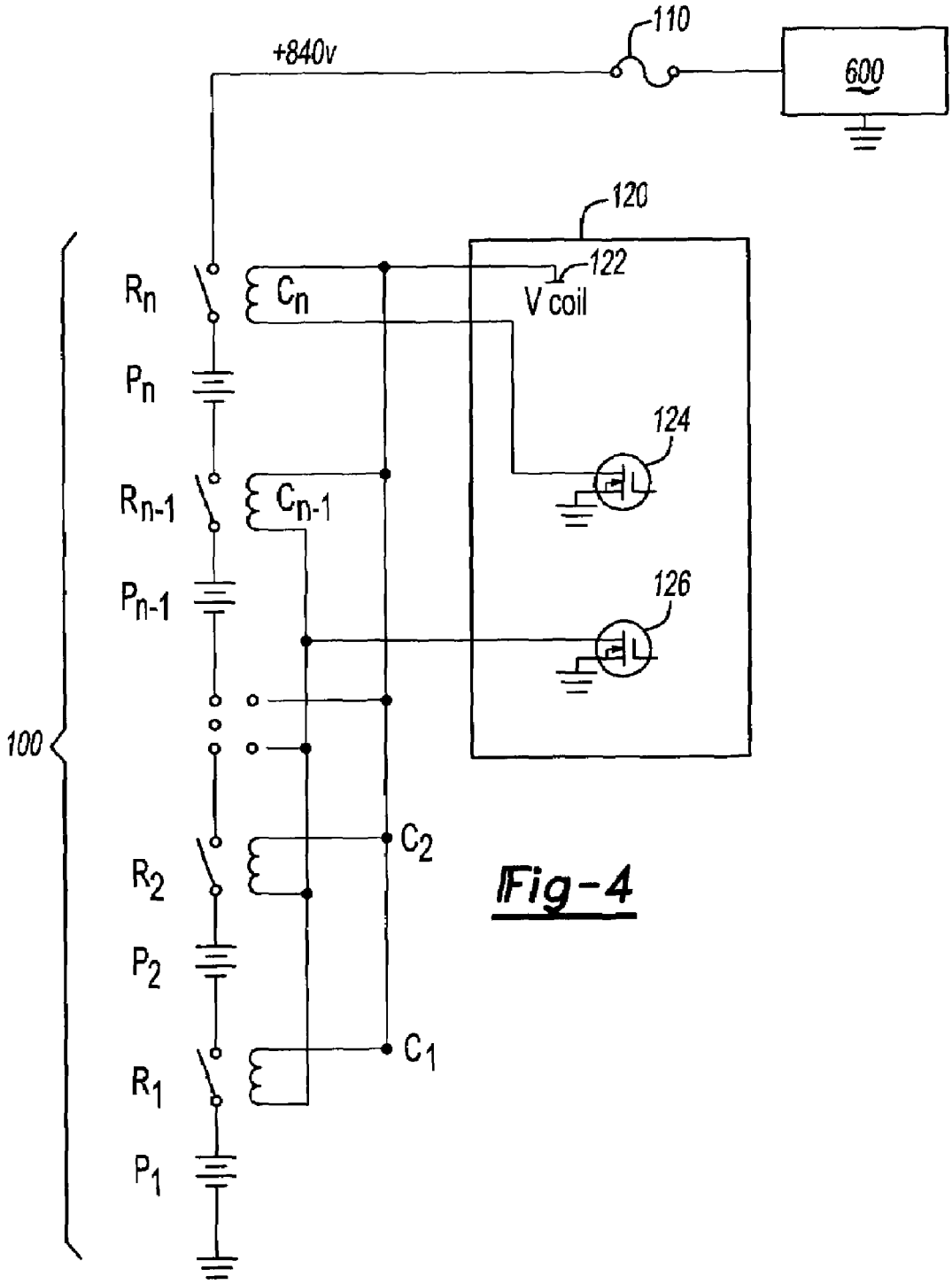
FIG. 4 is a circuit diagram that illustrates an embodiment of the present invention including details of the battery controller.

Illustrated in FIG. 4 is a simplified depiction of the battery controller 120 used in the previously discussed embodiments. Connected to one end of all the coils, C1–Cn, is a coil power supply 122 that provides the necessary current to energize the coils and close their respective relays. Although depicted as residing within battery controller 120, coil power supply 122 can readily be located separate from the battery controller 120. The remaining ends of the lower voltage rated coils, depicted as C1 through Cn-1 in FIG. 4, are all connected to a transistor switch 126 located within the battery controller 120. Similarly, the remaining ends of the higher voltage rated coils, which in FIG. 4 only includes coil Cn, are connected to transistor switch 124, also located within battery controller 120. Then by selectively opening and closing transistor switches 124 and 126, coils C1–Cn can be energized in the appropriate order, thereby closing and opening relays R1–Rn in the appropriate 2-step sequence, so as to protect the lower voltage rated relays by assuring they are closed first and opened last.

The present invention discloses a method and system allowing the use of lower voltage rated relays within a high voltage application. This is accomplished by means of a battery controller 120, which selectively activates and deactivates the relays such that lower rated relays are closed first and opened last while higher voltage rated relays are closed last and opened first. This means of controlling the relays works well under normal operating conditions. However, the lower voltage rated relays would still be subject to damage if power to the battery controller 120 or coil power supply 122 were ever disrupted. Under these abnormal conditions, all of the coils C1–Cn would be simultaneously de-energized, resulting in all the relays R1–Rn opening at roughly the same time. Under this situation, there is a significant chance that one of the lower rated relays will open first, thus experiencing the full voltage of voltage source 100. In terms of the hybrid or electric vehicle example, this situation could occur due to events such as a loose battery terminal, or a vehicle crash that results in an inertia safety switch 700 cutting power to the vehicle's systems.

Figure 5:
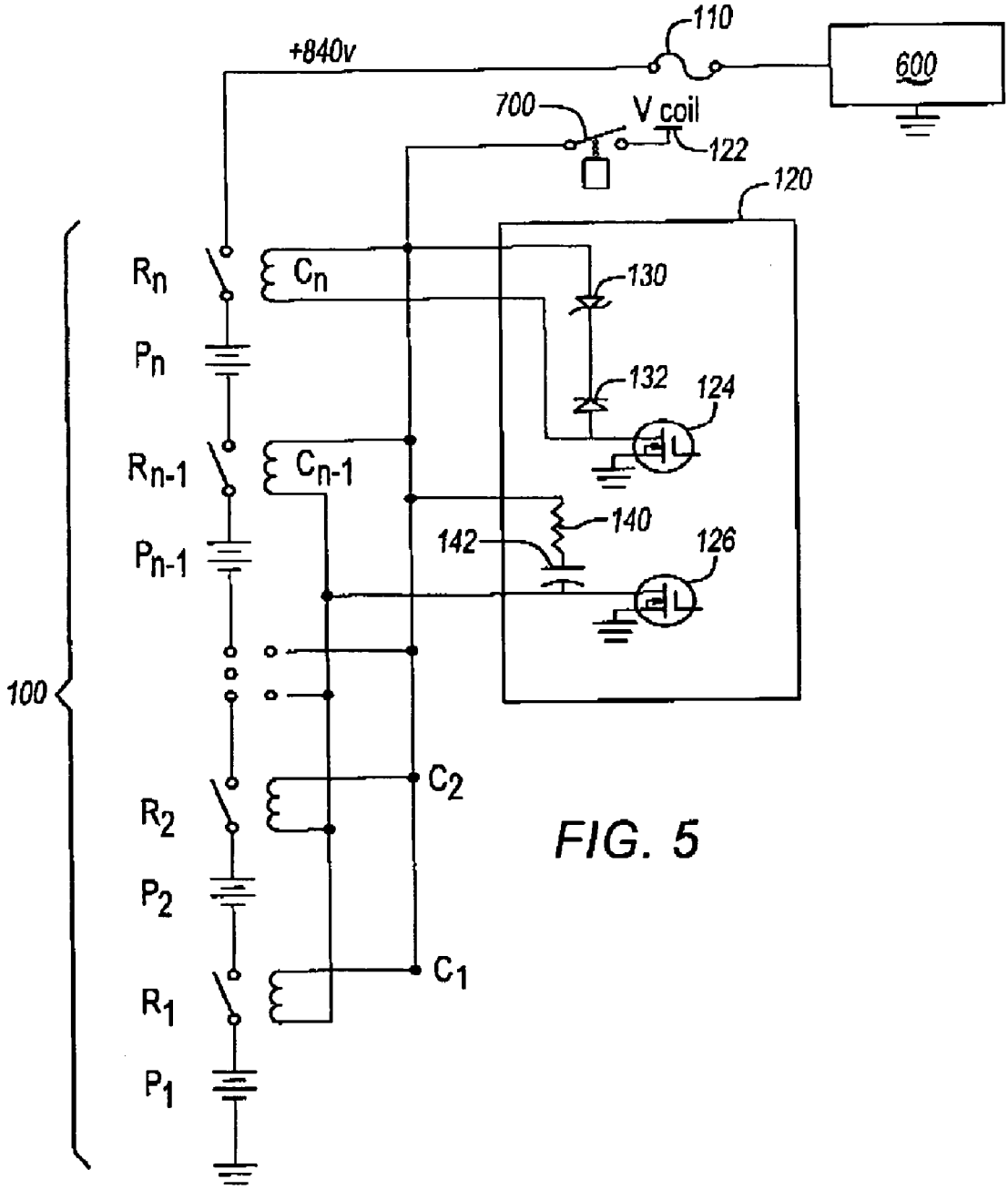
FIG. 5 is a circuit diagram that illustrates a further embodiment of the present invention, including circuitry for safely shutting down the circuit under abnormal conditions.

To compensate for the possibility of these abnormal conditions, the relay control circuit can be arranged according to the embodiment depicted in FIG. 5. According to this embodiment, a zener diode 130, regular diode 132, a resistance 140 and capacitance 142 are added to the battery controller 120. In the present embodiment, the resistance 140 and capacitance 142 are comprised of a resistor and capacitor, respectively, although other types of devices that possess the appropriate resistance or capacitance properties may also be utilized. The zener diode 130 and regular diode 132 are placed in series and arranged so as to form a current loop with the coil Cn associated with the higher voltage rated relay Rn. The diodes are further arranged so as to prevent any meaningful amount of current from flowing through them in a direction heading from coil power supply 122 to transistor switch 124. The resistance 140 and capacitance 142 are also placed in series and arranged so as to form a current loop with each of the coils Cn through Cn-1 associated with the lower voltage rated relays R1 through Rn-1.

Upon the loss of power, such as when inertia switch 700 disrupts the circuit, the energy stored in the inductive coils will begin to dissipate by means of the current loops. The diode 132 and zener diode 130 are selected so that during this period the combined voltage drop across them is greater than the total voltage drop that occurs across the combined resistance 140 and capacitance 142. Thus, during a power disruption there will be a greater voltage drop across coil Cn than there will be across each of coils C1 through Cn-1. Since the rate of change of inductor current is proportional to the voltage across it, the energy stored in coil Cn dissipates more quickly than the energy stored in coils C1 through Cn-1. Therefore, the magnetic effect produced by coil Cn dissipates quicker than that produced by each of the coils C1 through Cn-1. As a result, the high voltage rated relay Rn associated with coil Cn will open sooner than any of the lower voltage rated relays R1 through Rn-1 upon disruption of power to the coils. Thus, even during a power disruption to the coils, the lower voltage rated relays continue to be protected from damage by assuring that the higher voltage rated relay opens first. Although FIG. 5 illustrates this method in a circuit that has only one higher voltage rated relay, this same method can be implemented in relay control circuits with two or more such relays.

Figure 6:
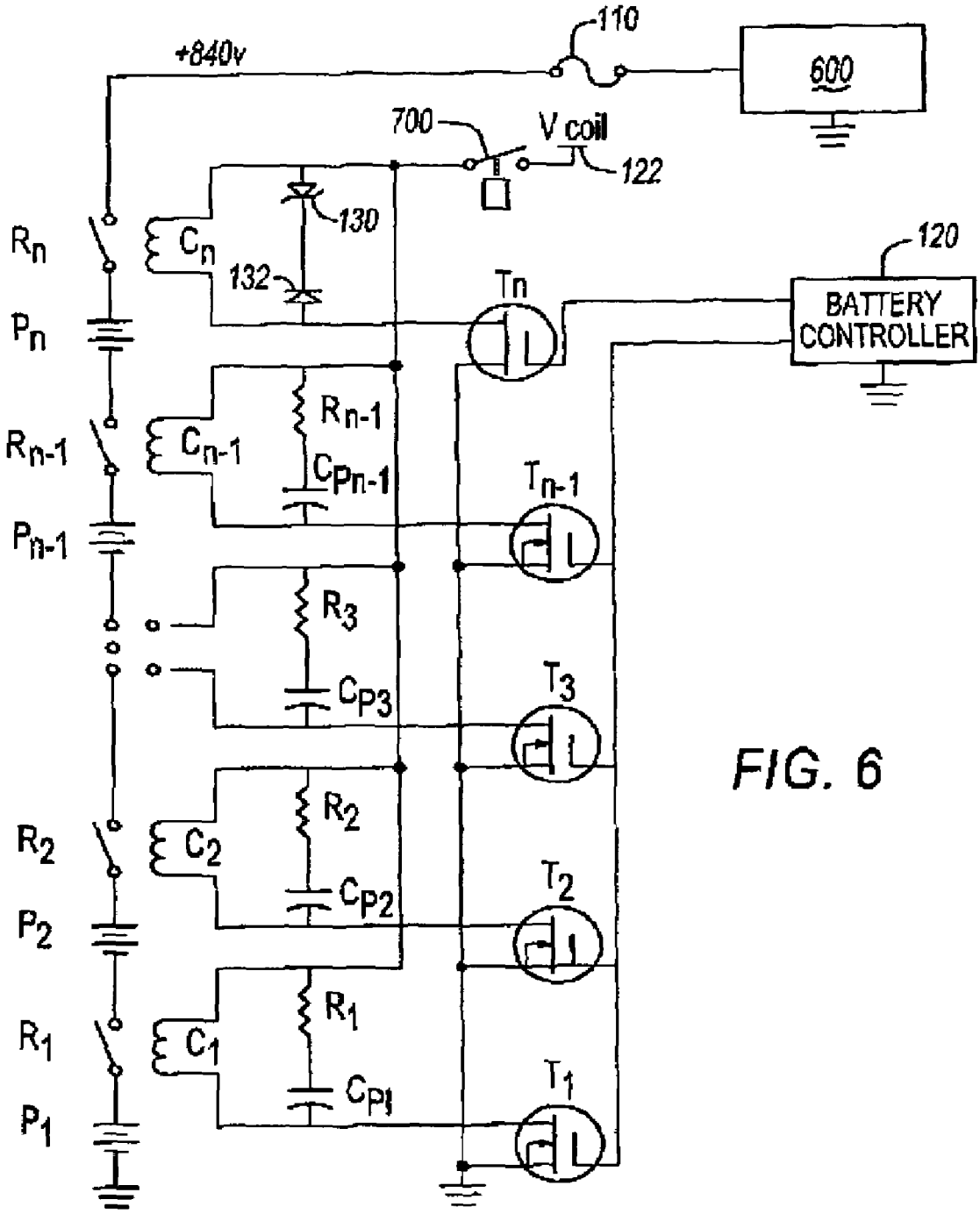
FIG. 6 is a circuit diagram that illustrates an alternative layout of the circuit of FIG. 5.

FIG. 6 illustrates a variation of the relay control circuit presented in FIG. 5. According to this embodiment, each relay is individually controlled by its own associated transistor switch T, instead of relying on one transistor for controlling the higher voltage rated relays, and one transistor for controlling the lower voltage rated relays. As before, the appropriately combined diode 132 and zener diode 130 can be added to the coils associated with each higher voltage rated relay, while a resistance R and capacitance C can be added to each of the coils associated with the lower voltage rated relays.

Although the workings of the present invention were illustrated with reference to a power supply of an electric or hybrid vehicle, the system and method disclosed herein are not limited to this specific application, but should be readily recognized as being applicable to any situation that requires the use of multiple relays to connect two or more power sources together.

While the invention has been specifically described in connection with certain specific embodiments thereof, it is to be understood that this is by way of illustration and not of limitation, and the scope of the appended claims should be construed as broadly as the prior art will permit.

What is claimed is:

1. An electric relay circuit for providing current to a load, comprising:

at least one first relay, said first relay rated for a first voltage level;

at least one second relay connected in series with said first relay, said at least one second relay rated for a second voltage level that is less than said first voltage level; and a controller that selectively activates said first relay and said second relay so that said second relay closes before said first relay closes, wherein the current is substantially switched to the load through said at least one first relay when said at least one first relay is closed.

2. The circuit of claim 1, wherein said controller selectively deactivates said first relay and said second relay so that said second relay opens after said first relay opens.

3. The circuit of claim 1, further comprising a plurality of lower-voltage relays connected in series with said first relay, each of said lower-voltage relays being rated for a voltage level that is less than said first voltage level.

4. The circuit of claim 3, wherein said controller includes a first transistor that controls said first relay and a second transistor that controls said plurality of lower-voltage relays.

5. The circuit of claim 3, wherein said controller includes a first transistor that controls said first relay and a plurality of transistors that correspond to said plurality of lower-voltage relays, each of said plurality of transistors controlling a corresponding one of said plurality of lower-voltage relays.

6. The circuit of claim 1, further comprising at least a first power source connected in series with said first relay and at least a second power source connected in series with said second relay such that said first and second power sources are connected in series to a load when said first and second relays are closed.

7. The circuit of claim 6, wherein said first and second power sources are batteries.

8. The circuit of claim 1, wherein said controller includes a fist transistor that controls said first relay and a second transistor that controls said second relay.

9. The circuit of claim 1, further comprising a power filter connected in parallel with said first and second relays in series.

10. The circuit of claim 9, wherein said power filter comprises at least one capacitance connected in parallel with said first and second relays in series.

11. The circuit of claim 10, wherein said at least one capacitance comprises two capacitances connected to each other in series.

12. The circuit of claim 9, wherein a load is driven by a voltage across said power filter.

13. The circuit of claim 1, wherein an end node of said series of first and second relays is grounded.

14. The circuit of claim 11, wherein a center node of said series of first and second relays is grounded, and a center node between said two capacitances is grounded.

15. The circuit of claim 1, further comprising means for opening said first relay prior to opening said at least one second relay upon disruption of an electric current driving said first and second relays.

16. The circuit of claim 15, wherein said means comprises:

a zener diode connected to said first relay, and a resistance and a capacitance connected to said at least one second relay.

17. A method for selectively connecting a plurality of power sources to a load comprising the steps of:

closing at least one first relay that is connected in series to a first power source, said first relay being rated for a first voltage level; and subsequent to closing said first relay, closing a second relay that is connected in series to said first power source and to a second power source, said second relay being rated for a second voltage level that is greater than said first voltage level, to connect said first and second power sources in series to a load, wherein the current is substantially switched to the load through said at least one first relay when said at least one first relay is closed.

18. The method of claim 17, further comprising the steps:

opening said second relay; and subsequent to opening said second relay, opening said at least one first relay.

19. An electric circuit, comprising:

a first relay connected in series with a first power source and a load, said first relay being rated for a first voltage level;

a plurality of lower-voltage relays each connected in series with a plurality of corresponding additional power sources, said lower-voltage relays being rated for one or more voltage levels lower than said first voltage level, wherein said series of lower-voltage relays is coupled between said first power source and ground; and a controller configured to selectively close said plurality of lower-voltage relays and subsequently close said first relay to connect said first power source and said additional power sources to a load, wherein the current is substantially switched to the load through said first relay when said first relay is closed.

20. The electric circuit of claim 19, wherein said controller is further configured to selectively open said first relay and subsequently open said plurality of lower-voltage relays to disconnect said first power source and said additional power sources from said load.

* * * * *